US008088050B2

(12) United States Patent
Aucamp

(10) Patent No.: US 8,088,050 B2
(45) Date of Patent: Jan. 3, 2012

(54) PORTABLE EXERCISE EQUIPMENT

(76) Inventor: Frederick P. Aucamp, Virginia Beach, VA (US)

( * ) Notice: Subject to any disclaimer, the term of this patent is extended or adjusted under 35 U.S.C. 154(b) by 138 days.

(21) Appl. No.: 12/384,452

(22) Filed: Apr. 6, 2009

(65) Prior Publication Data

US 2010/0255966 A1 Oct. 7, 2010

(51) Int. Cl.
*A63B 21/00* (2006.01)

(52) U.S. Cl. ..... 482/131; 482/91; 482/126

(58) Field of Classification Search ..... 482/82, 482/91, 116, 120, 122, 123, 126, 127, 129, 482/130, 131, 133, 138, 139, 906, 907, 908; 242/615, 615.2, 615.3

See application file for complete search history.

(56) References Cited

U.S. PATENT DOCUMENTS

| | | | | | |
|---|---|---|---|---|---|
| 189,356 | A | * | 4/1877 | Hanson et al. | 73/379.08 |
| 298,241 | A | * | 5/1884 | Schneider et al. | 254/395 |
| 458,855 | A | * | 9/1891 | Meinzer | 254/395 |
| 2,164,995 | A | * | 7/1939 | Linman | 24/136 K |
| 2,422,353 | A | * | 6/1947 | Hitt | 242/157 R |
| 2,483,760 | A | * | 10/1949 | Duncan | 254/395 |
| 2,829,891 | A | * | 4/1958 | Ludwig | 482/146 |
| 3,764,132 | A | | 10/1973 | Hepburn | |
| 3,843,119 | A | | 10/1974 | Davis | |
| 3,861,215 | A | | 1/1975 | Bradley | |
| 3,999,752 | A | * | 12/1976 | Kupperman et al. | 482/131 |
| 4,077,626 | A | | 3/1978 | Newman | |
| 4,257,592 | A | | 3/1981 | Jones | |
| 4,645,204 | A | | 2/1987 | Berger | |
| 4,733,862 | A | * | 3/1988 | Miller | 482/126 |
| 4,762,318 | A | * | 8/1988 | Phillips et al. | 482/126 |
| 4,787,630 | A | | 11/1988 | Watson | |
| 4,863,163 | A | * | 9/1989 | Wehrell | 482/123 |
| 4,911,440 | A | * | 3/1990 | Hyman et al. | 482/146 |
| 4,944,511 | A | | 7/1990 | Francis | |
| 5,171,295 | A | | 12/1992 | Schwalm, Jr. | |
| 5,261,864 | A | | 11/1993 | Fitzpatrick | |
| 5,429,572 | A | | 7/1995 | Brown | |
| 5,447,484 | A | | 9/1995 | Chandler | |
| 5,556,369 | A | | 9/1996 | Roberts | |
| 6,315,701 | B1 | | 11/2001 | Shifferaw | |
| 6,612,170 | B2 | | 9/2003 | Brown | |
| 6,729,606 | B1 | * | 5/2004 | Durin | 254/395 |
| 6,866,617 | B2 | * | 3/2005 | Chen | 482/124 |
| 7,250,021 | B2 | * | 7/2007 | Leight | 482/116 |
| 7,316,636 | B1 | * | 1/2008 | Hinds et al. | 482/126 |
| 7,322,909 | B1 | * | 1/2008 | Loccarini et al. | 482/129 |
| 7,364,538 | B2 | | 4/2008 | Aucamp | |
| 7,591,763 | B1 | * | 9/2009 | Fucci | 482/52 |
| 7,607,643 | B1 | * | 10/2009 | Box et al. | 254/338 |
| 2003/0211920 | A1 | * | 11/2003 | Mandel | 482/116 |

(Continued)

*Primary Examiner* — Loan Thanh
*Assistant Examiner* — Daniel Roland
(74) *Attorney, Agent, or Firm* — William G. Sykes

(57) ABSTRACT

An exercise device having a thin, hollow, rectangular body and having a planar upper surface to receive a portion of a user's body thereupon. Each of a pair of handles is attached to respective ends of a cord that passes through a first guide mechanism located at a front corner of the upper surface, through an interior portion of the body and back through a second guide assembly located at a second front corner of the upper surface. Each guide assembly consists of four mutually orthogonal rollers defining a central, rope-accepting opening in the middle thereof. One or both handles may be adjustably attached to the cord to allow use of the exercise device by different height. The exercise device may include a handle attached to the body and one or more feet disposed on a lower surface of the body.

12 Claims, 11 Drawing Sheets

U.S. PATENT DOCUMENTS

2006/0128540 A1* 6/2006 Engle ..... 482/123
2006/0199706 A1* 9/2006 Wehrell ..... 482/92
2007/0129226 A1* 6/2007 Leavitt ..... 482/129
2009/0098987 A1* 4/2009 McBride et al. ..... 482/133

* cited by examiner

PORTABLE EXERCISE EQUIPMENT

RELATED APPLICATIONS

The present application is related to my U.S. patent application Ser. No. 11/485,907 for MOBILE EXERCISE EQUIPMENT, filed Jul. 13, 2006, now issued as U.S. Pat. No. 7,364,538, included herein in its entirety by reference.

FIELD OF THE INVENTION

The invention pertains to exercise equipment and, more particularly, to a portable, variable resistance exercise device that may readily be transported and stored, and that facilitates a wide variety of possible exercise regimes.

BACKGROUND OF THE INVENTION

Physical conditioning through regular exercise has long been considered important in achieving and maintaining good overall health. There are many approaches that an individual may take in establishing an exercise regime for him or herself.

For example, it is generally recognized that building and toning of the muscles in the upper body may effectively be achieved by work with free weights. Typically, free weight workouts involve the use of barbells of various sizes.

Although work with free weights is highly popular, such work has a number of inherent problems. First, because of the need for different weights for different people and even for different exercises by the same person, a large number of weights are required. This may lead to high costs, storage difficulties and other problems. Safety is also a serious problem associated with the use of heavy weights, and injuries are unfortunately rather commonplace. Finally, barbells are normally suitable for use only at home or at an exercise facility because of the difficulty of carrying them from place to place. Thus, free weights are not often used in workouts conducted in offices or during out-of-town travel.

Exercise equipment is available ranging in size from large stationary machines costing thousand of dollars to smaller and simpler items such as jump ropes and small weights. While numerous types of exercise machine have been developed, these machines are typically large stationary devices that are useful only at one location. A brake or other friction device that is effective only in one direction usually provides a resistive force. For example, brake resistance devices offer resistance only when a rope is pulled or extended, and the rope retracts freely without offering significant resistance. This is a serious drawback in that physiologists and other fitness experts recognize that muscle development is greatly enhanced if near equal resistance is provided both during extension and retraction (or raising and lowering). Existing devices are further characterized by difficulty in adjusting the resistive force, if it is adjustable at all, and by undue limitations on the range of resistance.

It would, therefore, be desirable to provide an exercise apparatus that overcame the numerous problems of prior art exercise equipment. Such a device should be lightweight, compact, transportable, easy to store, relatively inexpensive, and easy to adjust to provide many possibilities for exercise regimes.

SUMMARY OF THE INVENTION

In accordance with the present invention there is provided an exercise device that comprises a base having a planar upper surface upon which the user places his or her feet, back or other part of the body when different exercises are performed. The base includes a groove, trough, channel, chase or raceway for accommodating a cord that connects a pair of handles together in an adjustable manner.

The present invention may be used to perform numerous different exercises that include chest, shoulder, back, arm, leg and the torso muscles. The length of the cord is adjustable to accommodate different-sized individuals and different exercises such that the device may be manufactured provided in a single, universal size. The resistance for a particular exercise is the counter force applied by the arm or opposing body part that is moved in a manner to counter the other arm or other body part doing the exercise movement. This resistant can be varied from repetition to repetition or varied during an individual repetition. The device may also be used for isometric training, i.e. exertion of force without movement.

The level of resistance in the present device may be varied according to a level of resistance provided by an opposing arm or its associated muscles.

The portable exercise device of the present invention may be easily carried and stored. More particularly, the present invention relates to a piece of variable resistance exercise equipment that includes a base and a pair of opposing handles. The opposing handles are coupled together via a cord. Each of the handles may be selectively positioned along the cord to facilitate performance of a wide variety of exercises. By providing positionability of both handles on the cord, the adjustability of the device is greatly enhanced and a single device may be produced to accommodate users of many different sizes performing a wide variety of exercises.

It is, therefore, an object of the invention to provide a portable exercise device that is lightweight and readily transportable.

It is another object of the invention to provide a portable exercise device that is useful for performing a wide variety of variable resistance exercises.

It is an additional object of the invention to provide a portable exercise device that includes two handles, each adjustable positionable along a cord connecting the handles.

It is a further object of the invention to provide a portable exercise device that includes a planar upper surface for accommodating various regions of a user's anatomy.

It is a still further object of the invention to provide a portable exercise device that includes a pair of guide roller assemblies, each having four mutually orthogonal rollers to reduce friction on the handle-interconnecting cord, regardless of the direction the cord is directed by the user.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein:

FIG. 4 is an exploded, perspective view of the exercise device of FIG. 1*a.

DETAILED DESCRIPTION OF THE PREFERRED EMBODIMENT

Figure 1A:
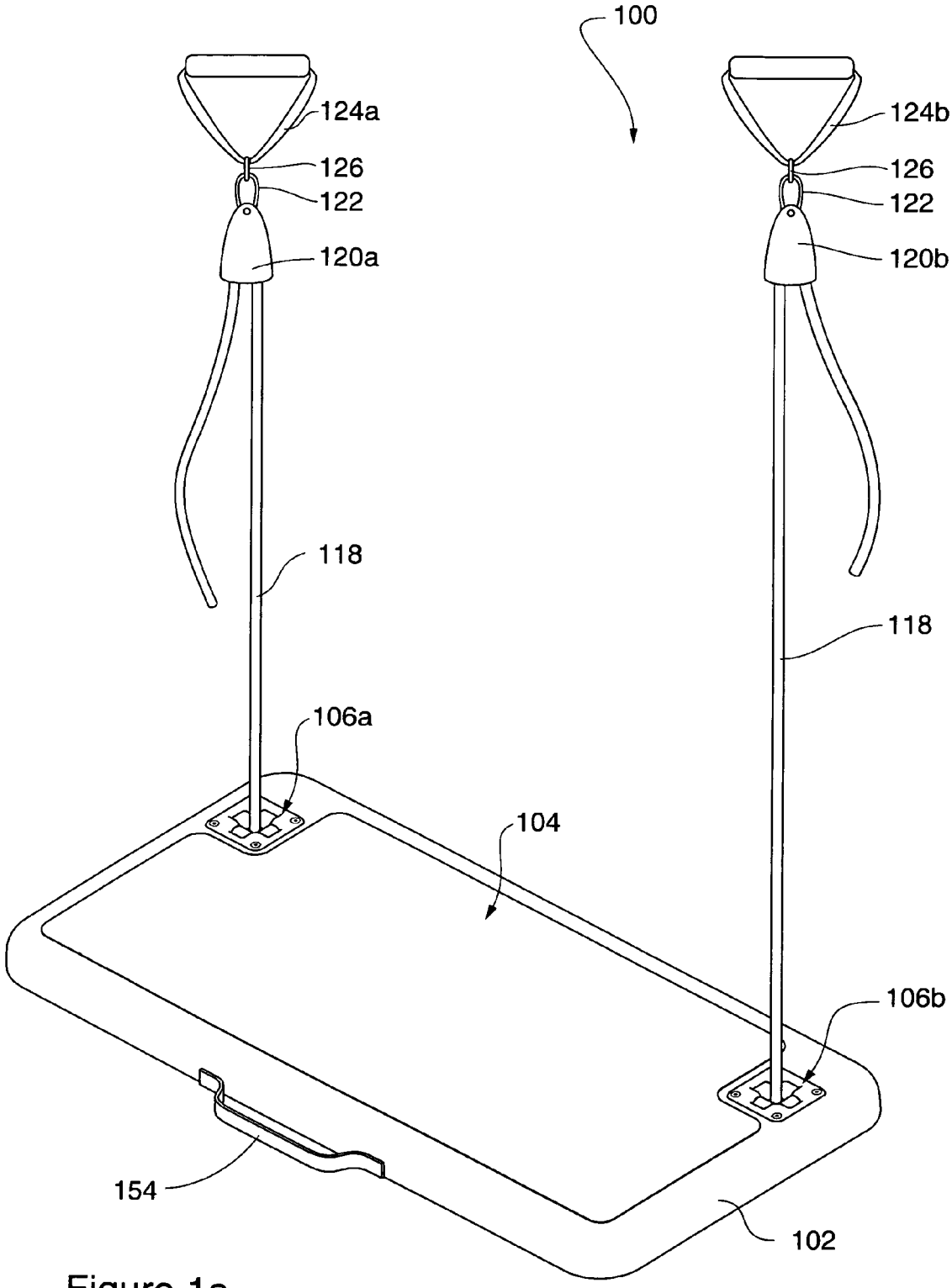
FIG. 1*a* is a top, perspective view of the exercise device in accordance with the invention.
Figure 1B:
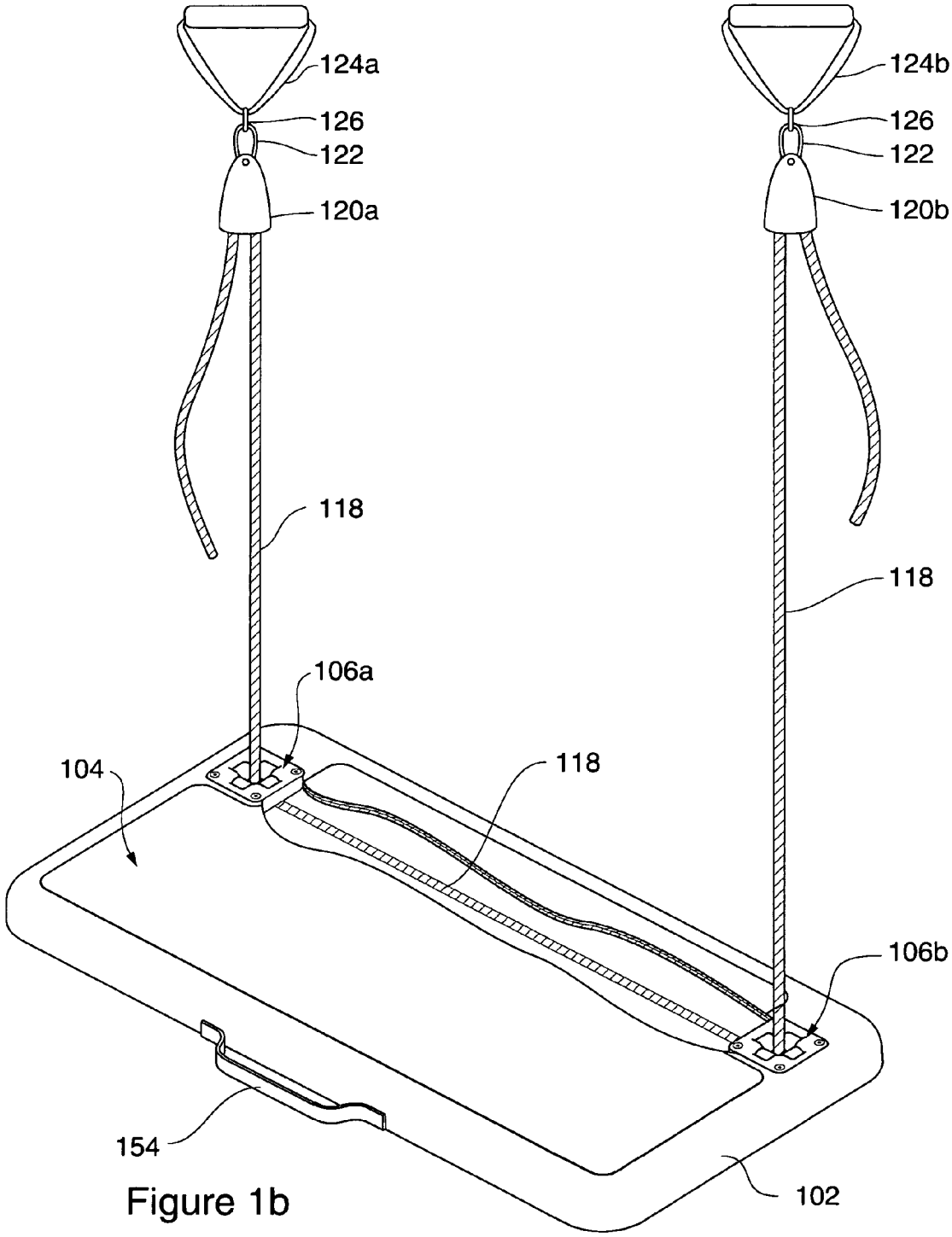
FIG. 1*b* is a partially cut away top, perspective view of the exercise device of FIG. 1*a;*

The present invention provides a portable exercise device. Referring first to FIGS. 1*a* and 1*b*, there are shown a top right, perspective view, and a partially cut away, top right, perspective view, respectively, of the exercise device in accordance with the present invention, generally at reference number 100.

Portable exercise device 100 is a squat, rectangular parallelepiped having a substantially hollow body 102. Body 102 has an upper surface 104 adapted to receive a foot, back, or other portion of the human anatomy, (see FIGS. 5-12) depending upon the nature of the desired exercise.

A pair of guide mechanisms 106*a*, 106*b* are disposed in the left front corner and right front corner, respectively of top surface 104 of exercise device 100.

Figure 2:
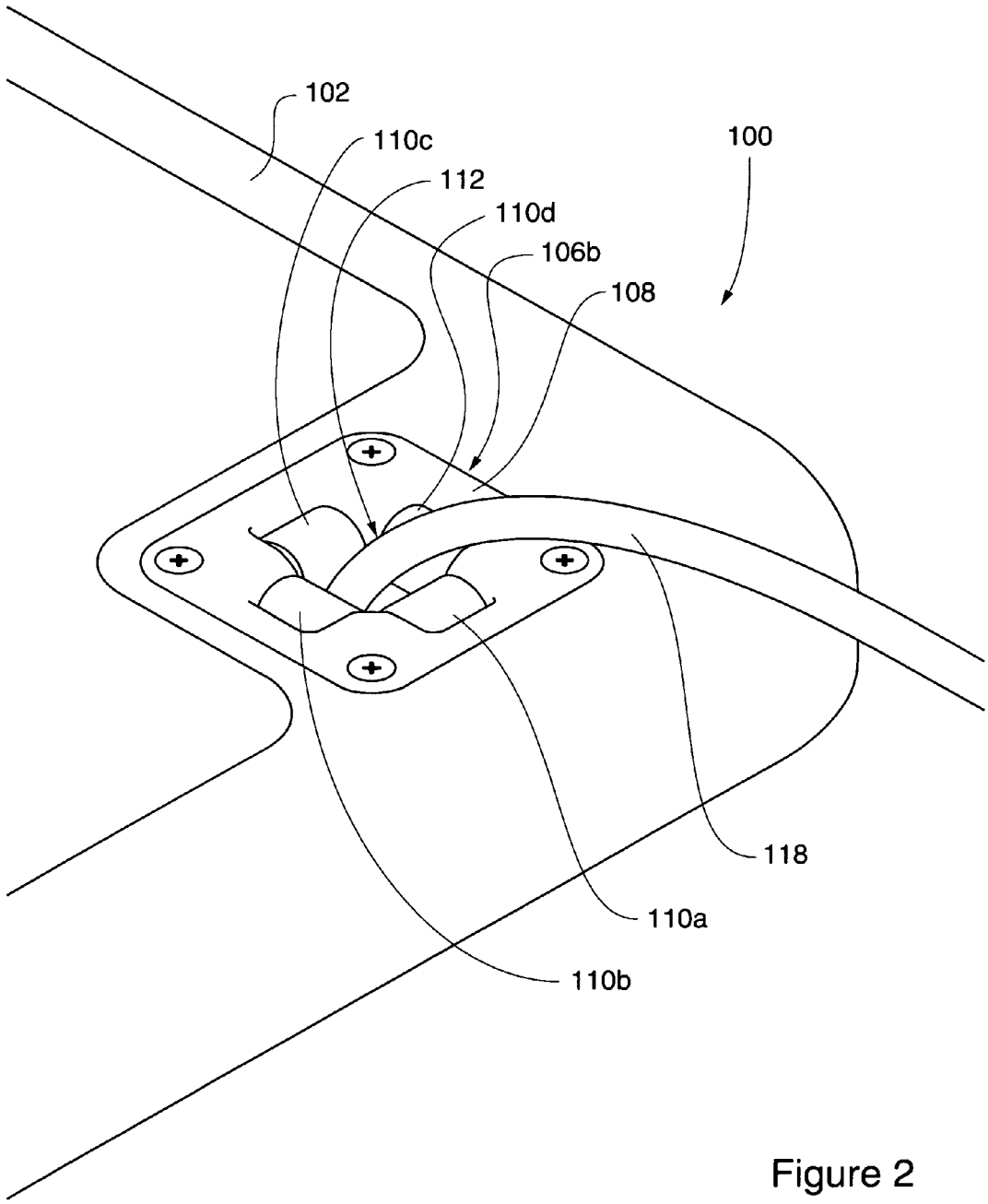
FIG. 2 is a detailed portion of a top plan view of the exercise device of FIG. 1*a;*

Referring now also to FIG. 2, there is shown a detailed view of guide mechanisms 106*b*. Guide mechanisms 106*a* and 106*b* are identical. For simplicity, only right guide roller mechanism 106*b* is shown in FIG. 2.

A support block 108 supports a quartet of guide rollers 110*a*-110*d* disposed mutually perpendicularly to one another so as to define a central, rope-accepting opening 112. Each guide roller 110*a*-110*d* is free to rotate on a respective axle 130*a*-130*d*, best seen in FIG. 4. Guide mechanisms 106*a*, 106*b* are disposed within body 102 such that they do not protrude beyond upper surface 104.

Screws 114 secure guide mechanisms 106*a*, 106*b* to body 102. Screws 214 are typically self-tapping type flat head screws. The heads of screws 114 are countersunk into support block 108 leaving a substantially flat surface exposed to contact by a user 160 (FIGS. 5-12) of portable exercise device 100. However, it will be recognized by those of skill in the art that other types of screw or other types of fastener may be substituted therefore. In alternate embodiments, left and right mechanisms 106*a*, 106*b*, respectively, may be secured to body 102 using adhesive. Consequently, the invention is not limited to the particular fastener arrangement chosen for purposes of disclosure. Rather, the invention includes any suitable fastener, whether mechanical or adhesive.

A cord 118 is disposed in central, rope-accepting opening 112. Central opening 112 is typically sized such that a surface of cord 118 contacts an outer surface, not specifically identified, of at least one of guide rollers 110*a*-110*d*, thereby allowing cord 118 to pass through central opening 112 with minimum friction, regardless of the direction in which cord 118 may be pulled when exercise device 100 is in use. As used herein, the term cord is used to refer to any elongated flexible member (e.g., a rope or cable, etc.) that interconnects the pair of handles 124*a*, 124*b*.

A pair of handles 124*a*, 124*b* are provided for gripping by the hand of a user 160 (FIGS. 5 - 12) of exercise device 100. As may readily be seen, handles 124*a*, 124*b* are simple handles having no cord winding or other similar mechanism contained in or directly attached thereto. Handles 124*a*, 124*b*each have an attachment eye 126 adapted for connection to a respective snap hook 122 of cord length adjusting mechanisms 120*a*, 120*b*. It will be recognized that numerous possibilities, all believed to be known to those of skill in the art, may be substituted for the combination of snap hook 122 and handle attachment eye 126 for securing a handle to cord length adjusting mechanisms 120*a*, 120*b*.Consequently, the invention is not considered limited to the particular attachment system chosen for purposes of disclosure. Rather, the invention covers any and all suitable attachment systems and devices.

Figure 3A:
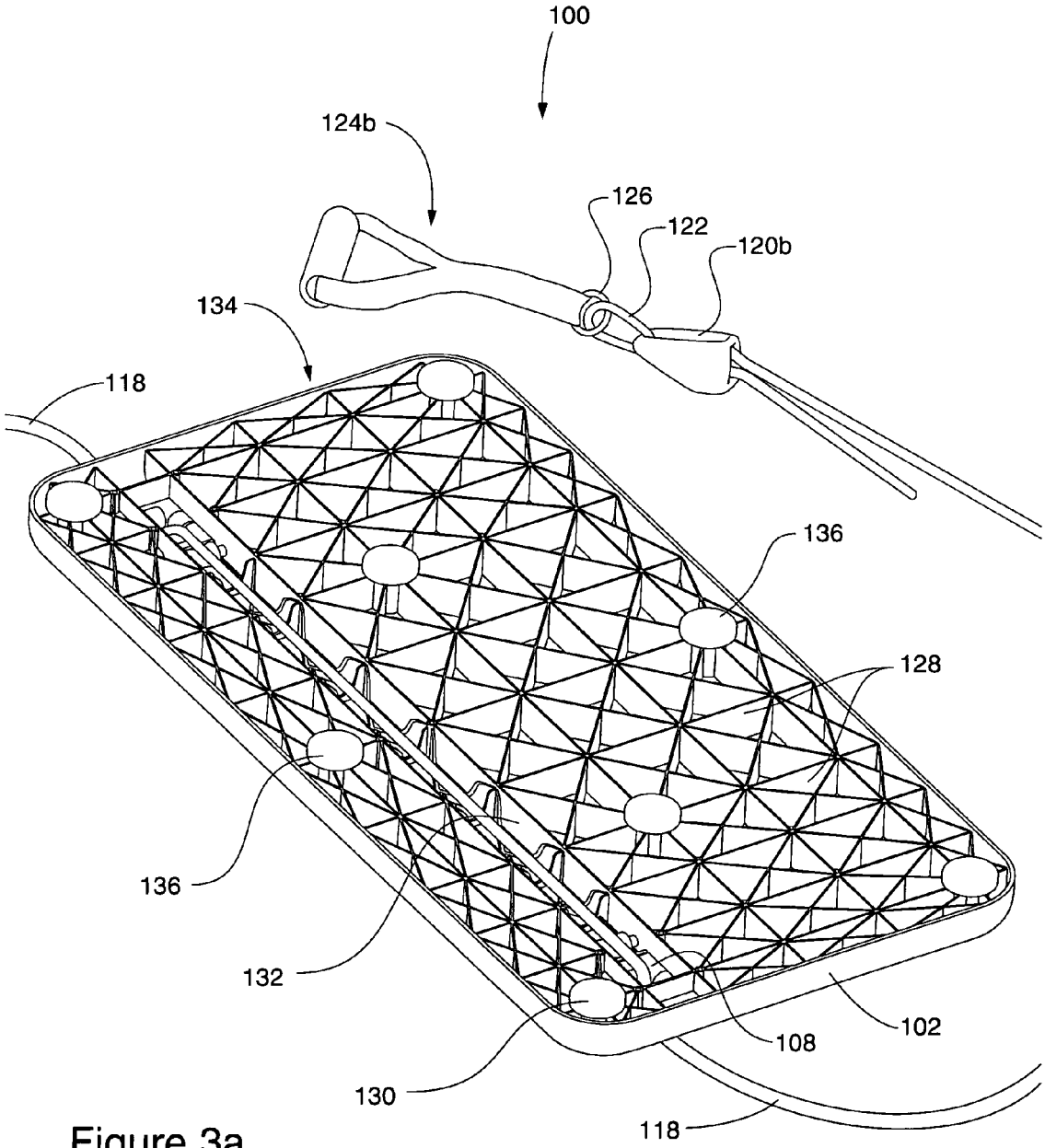
FIG. 3*a* is a right bottom, perspective view of the exercise device of FIG. 1*a;*
Figure 3B:
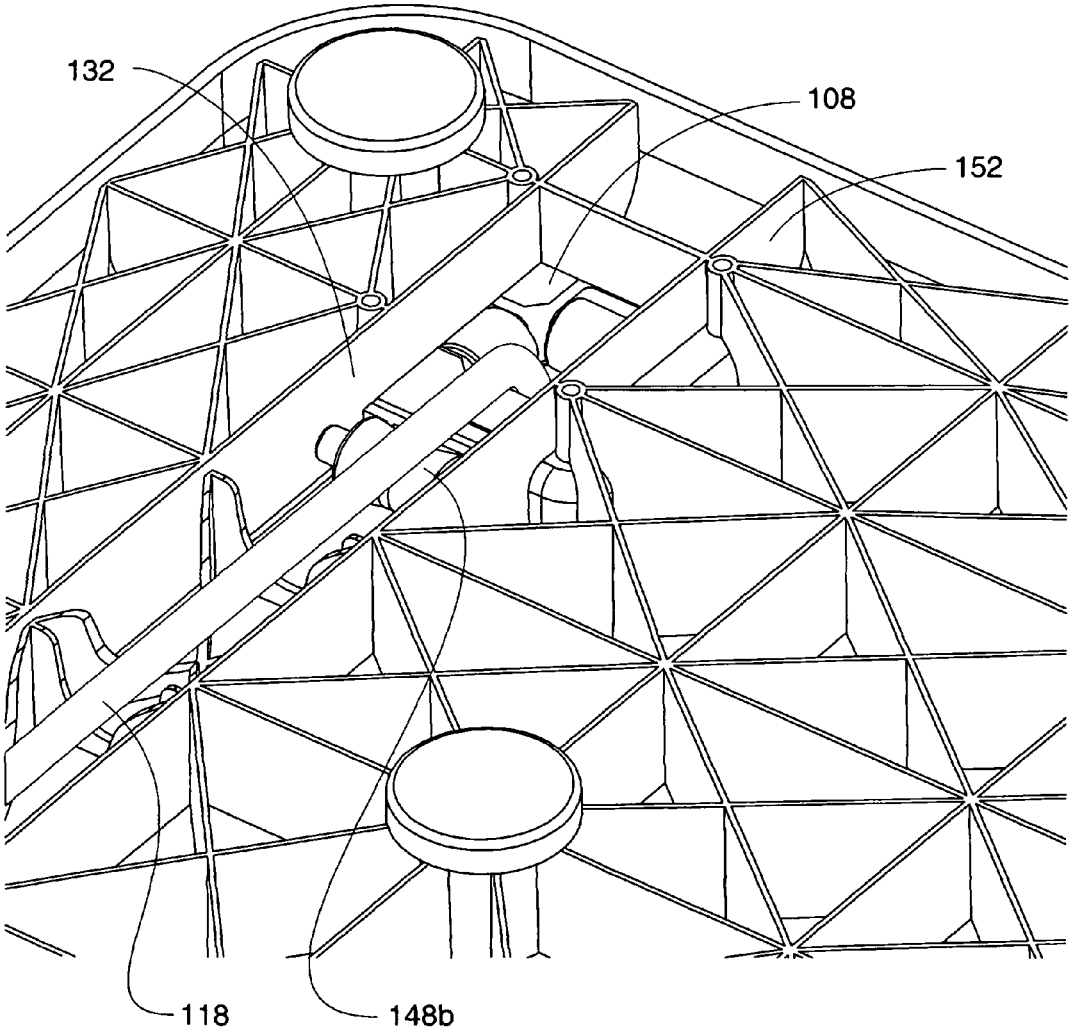
FIG. 3*b* is a detailed, partial view of the exercise device of FIG. 3*a;*

Referring now also to FIGS. 3*a* and 3*b*, there are shown a right bottom, perspective view, and an enlarged portion of a bottom right, perspective view, respectively, of portable exercise device 100. Body 102 of exercise device 100 is typically molded from a polymeric material and includes numerous ribs 128 disposed on the major bottom surface 134 thereof. Such molded, ribbed structures are believed to be well known to those of skill in the art. Consequently, such structures are not further discussed herein. Body 102 may be formed from materials such as ABS by injection molding. Other suitable materials and/or forming techniques also known to those of skill in the art may alternately be used to form body 102. Therefore, the invention is not considered limited the particular material chosen for purposes of disclosure, or to a particular molding or other forming process or technique. Rather, the invention comprehends any and all suitable materials and/or forming processes.

An elongated trough 132 is formed in the bottom surface 134. Trough 132 extends between guide roller mechanisms 106*a*, 106*b*.

A number of foot-retaining openings 136 are also molded onto bottom surface 134 of body 102.

Figure 4:
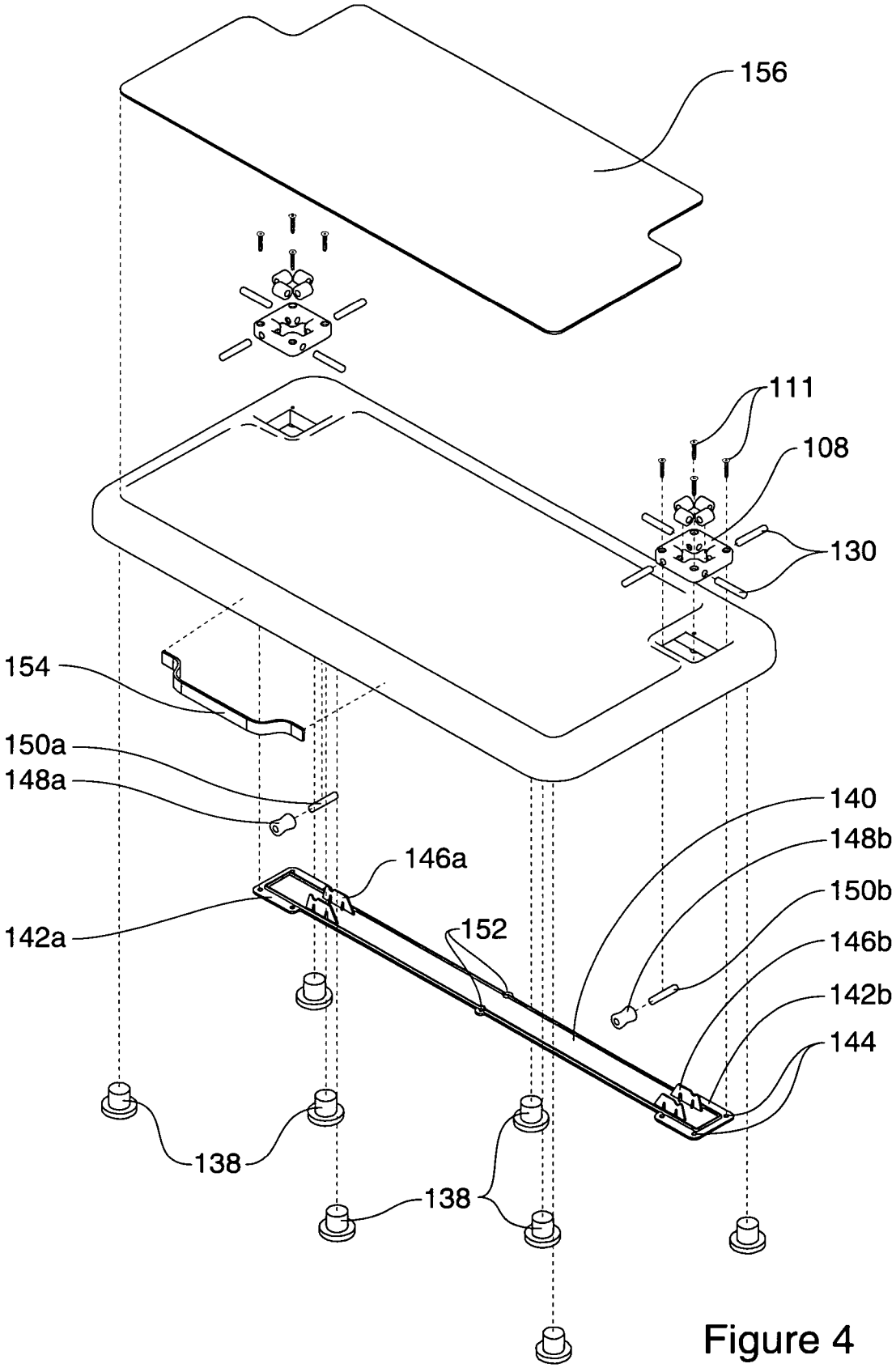

Referring now also to FIG. 4, there is shown an exploded, perspective view of portable exercise device 100. A roller support assembly 140 having flanges 142*a*, 142*b* disposed at proximal and distal ends thereof, respectively, is adapted for mounting in elongated trough 134. Holes 144 in flanges 142*a*, 142*b* are adapted to receive screws 114. Screws 114 secure roller support assembly 140 to body 102 within elongated trough 132.

Roller support brackets 146*a*, 146*b* disposed adjacent to but slightly inward from respective flanges 142*a*, 142*b* support axles 150*a*, 150*b* carrying rollers 148*a*, 148*b*, respectively.

A pair of dimples or protrusions 152 are provided proximate a mid point along a major axis of roller support assembly 140. Protrusions 152 are provided for frictional engagement with features, not shown, provided in a sidewall, not specifically identified, of elongated trough 132. Protrusions 152 retain a central portion of roller support assembly within trough 132 of body 102.

A top member 156 is attached to a central region of upper surface 104 of body 104. Top member 156 is typically formed from a resilient material and provides a padded surface for contact with user 160 (FIGS. 5-12).

In operation, cord length adjusting mechanisms 120*a*, 120*b* are used to position respective handles 124*a*, 124*b* at an appropriate position on respective ends of cord 118. A user 160 then positions a desired portion his or her body on upper surface 104 of exercise device 100. Handles 124*a*, 124*b* are alternately pulled to accomplish the desired exercise. Cord 118 passes across one of guide rollers 110*a*-110*d* of each of guide mechanisms 106*a*, 106*b* and through respective central rope accepting openings 112. Cord 118 passes across rollers 148*a*, 148*b* of roller support assembly 140.

Numerous exercises may be performed utilizing portable exercise device 100. FIGS. 5-12 schematically represent several representative exercise postures that a user 160 may find useful when utilizing portable exercise device 100.

Figure 5:
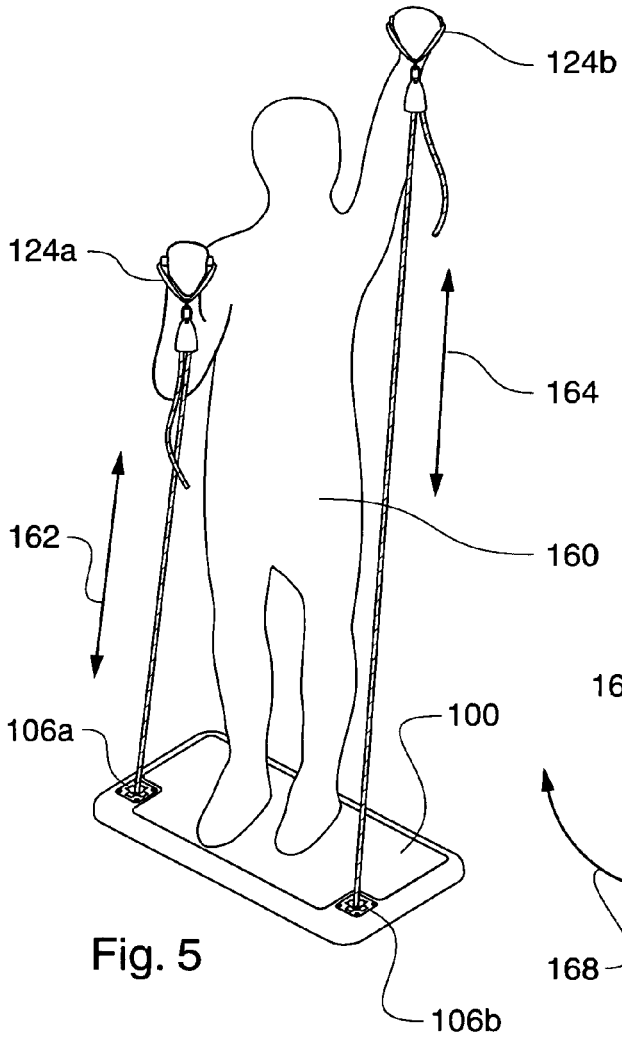
* and FIGS. 5-12 are schematic, perspective views of the exercise device of FIG. 1 being utilized to perform various exercises.

FIG. 5 is a schematic representation of a first exercise posture wherein the user 160 stands erect on exercise device 100 such that his or her toes or the balls of his feet are centered between left and right guide mechanism 106*a*, 106*b*. For brevity, the terms he, his, and him shall be used hereinafter to represent both male and female users of exercise device 100. The user 160 grasps the handles 124*a*, 124*b* with his palms, not specifically identified, facing away from his body. The arms are fully flexed with hands in front of the shoulders. One arm is pushed upward while the other is drawn downward toward one of guide mechanisms 106*a*, 106*b*. This motion is then repeated such that the other arm is raised as the opposite arm is lowered in a climbing motion, as indicated by the arrows 162, 164.

Figure 6:
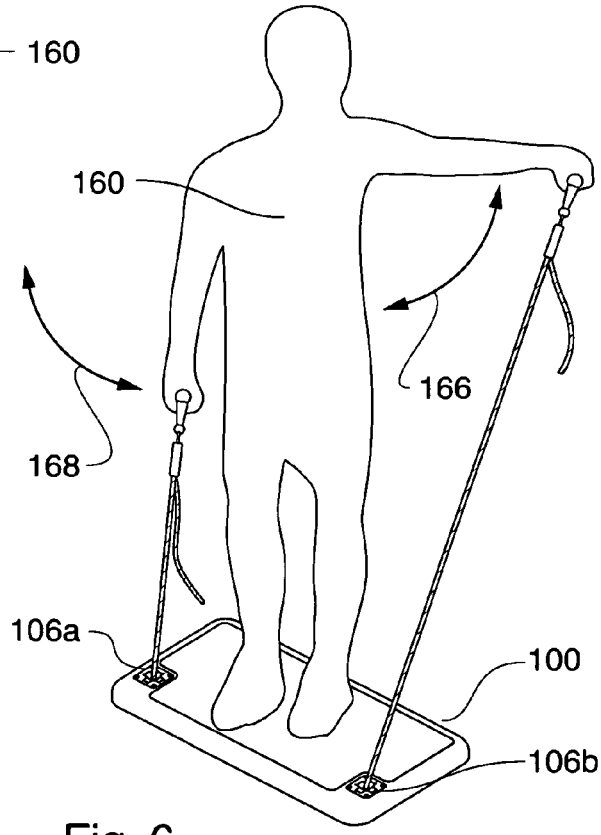

FIG. 6 depicts a second exercise posture wherein the user 160 stands erect with his palms facing his sides. One arm is kept straight while being raised as shown by arrow 166 to a substantially perpendicular, horizontal angle relative to the vertical height of the user. This arm is then lowered while being kept straight; simultaneously, the opposite arm is raised in the manner previously mentioned and as indicated by the arrows 166, 168.

Figure 7:
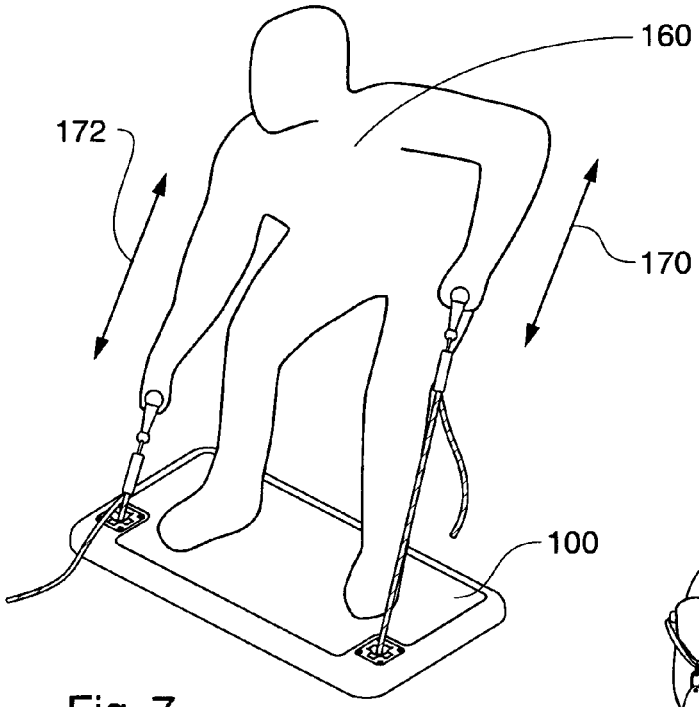

FIG. 7 depicts a third exercise posture wherein the user 160 stands bent over at the waist while maintaining a straight back. The user's palms face his sides. One arm is first raised by bending it at the elbow as shown by arrow 170. The first arm is then straightened. The exercise is repeated by reversing the order of exercise of each arm, arrow 172. This exercise is a rowing motion that works the upper back and shoulders.

Figure 8:
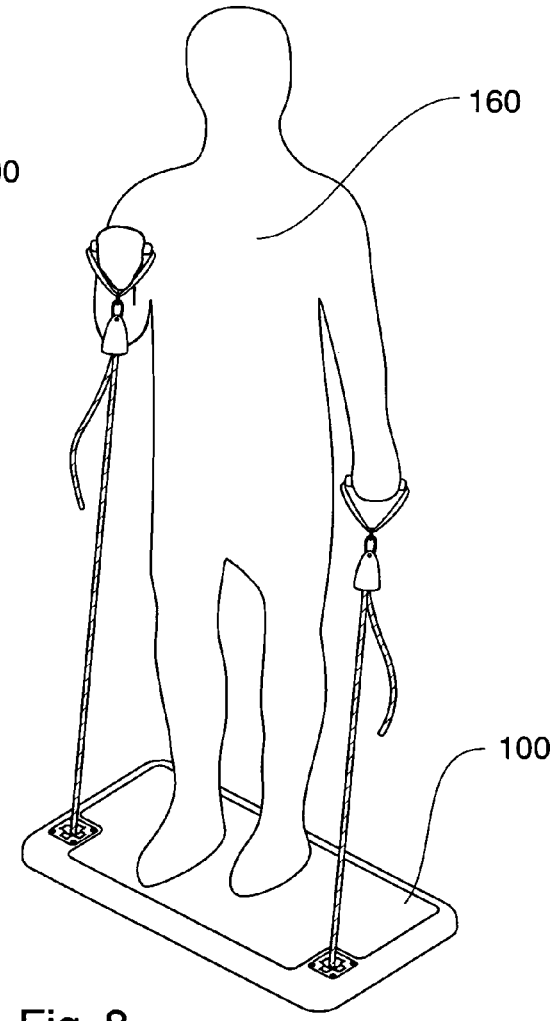

FIG. 8 depicts a fourth exercise posture wherein the user 160 performs bicep curls. The user stands erect with his palms facing forward in an underhand fashion, as shown. The first arm is raised as the other is lowered while keeping the elbows stationary. The other arm is then raised while the first arm is lowered.

Figure 9:
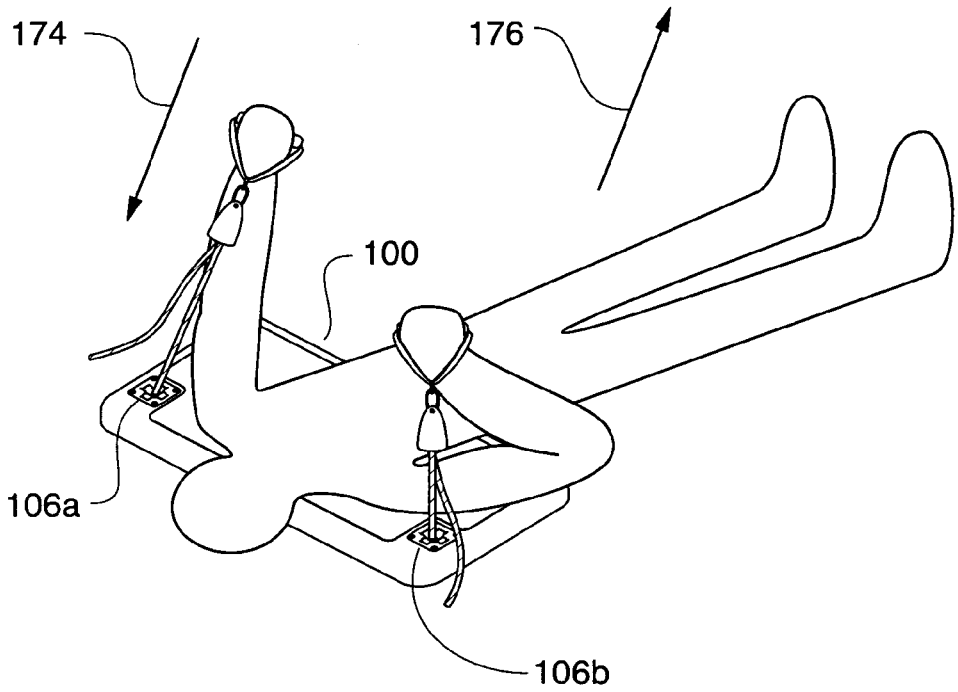

FIG. 9 depicts a fifth exercise posture the user 160 is lying on exercise device 100 with his palms facing up and each arm bent. While keeping elbows stationary, one arm is extended until it is straight as shown by arrow 176; while, the hand on the other is pulled towards the respective guide mechanism 106*a*, 106*b* as shown by arrow 174. The motions of the arms are then reversed and alternated.

Figure 10:
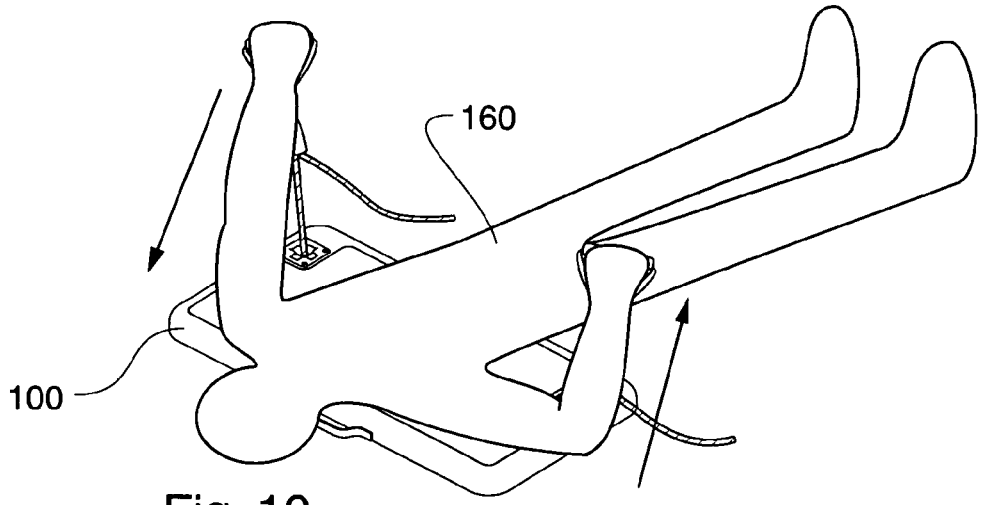

FIG. 10 depicts a sixth exercise posture wherein a chest press exercise is executed. The user 160 lies with his back with exercise device 100 positioned under his upper back. One arm is straight and extended with a palm facing forward towards his feet. The other arm is bent with the arm facing forward. The straight arm is bent while the bent arm is straightened.

Figure 11:
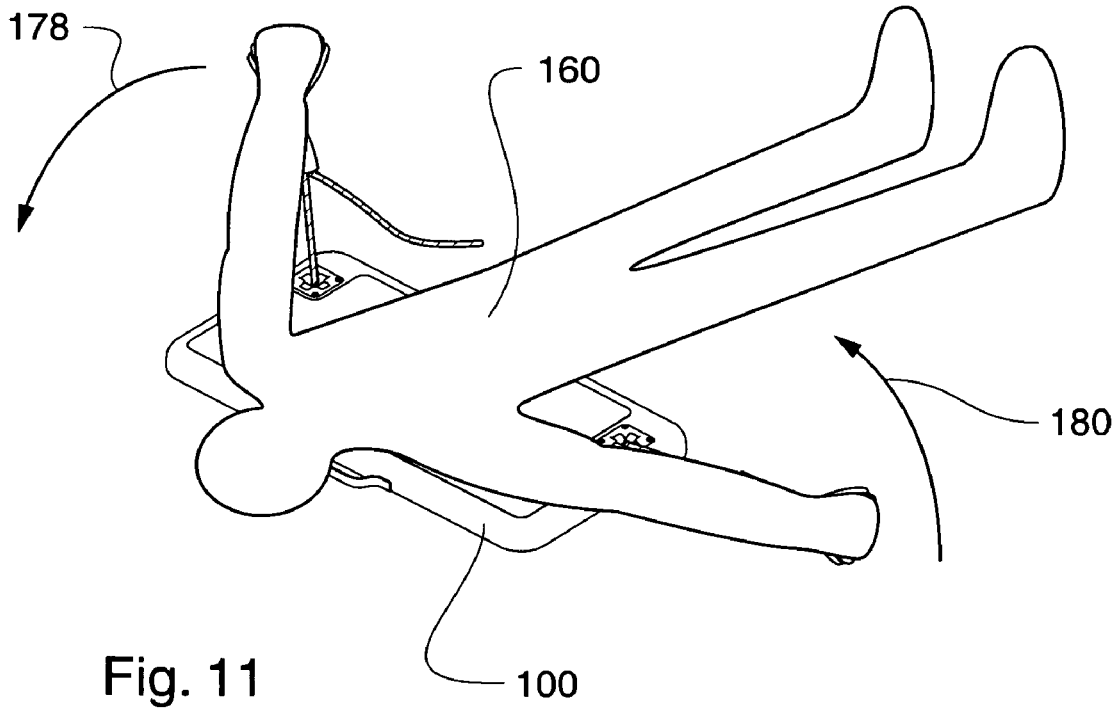

FIG. 11 depicts a seventh exercise posture wherein another chest exercise. The user 160 lies on his back as shown. Both arms are straightened with one extended to the side on the floor and the other extending away from and above the body. The arm on the floor is swung upward while the other arm is lowered to the floor. These motions are in accordance with arrows 178, 180.

Figure 12:
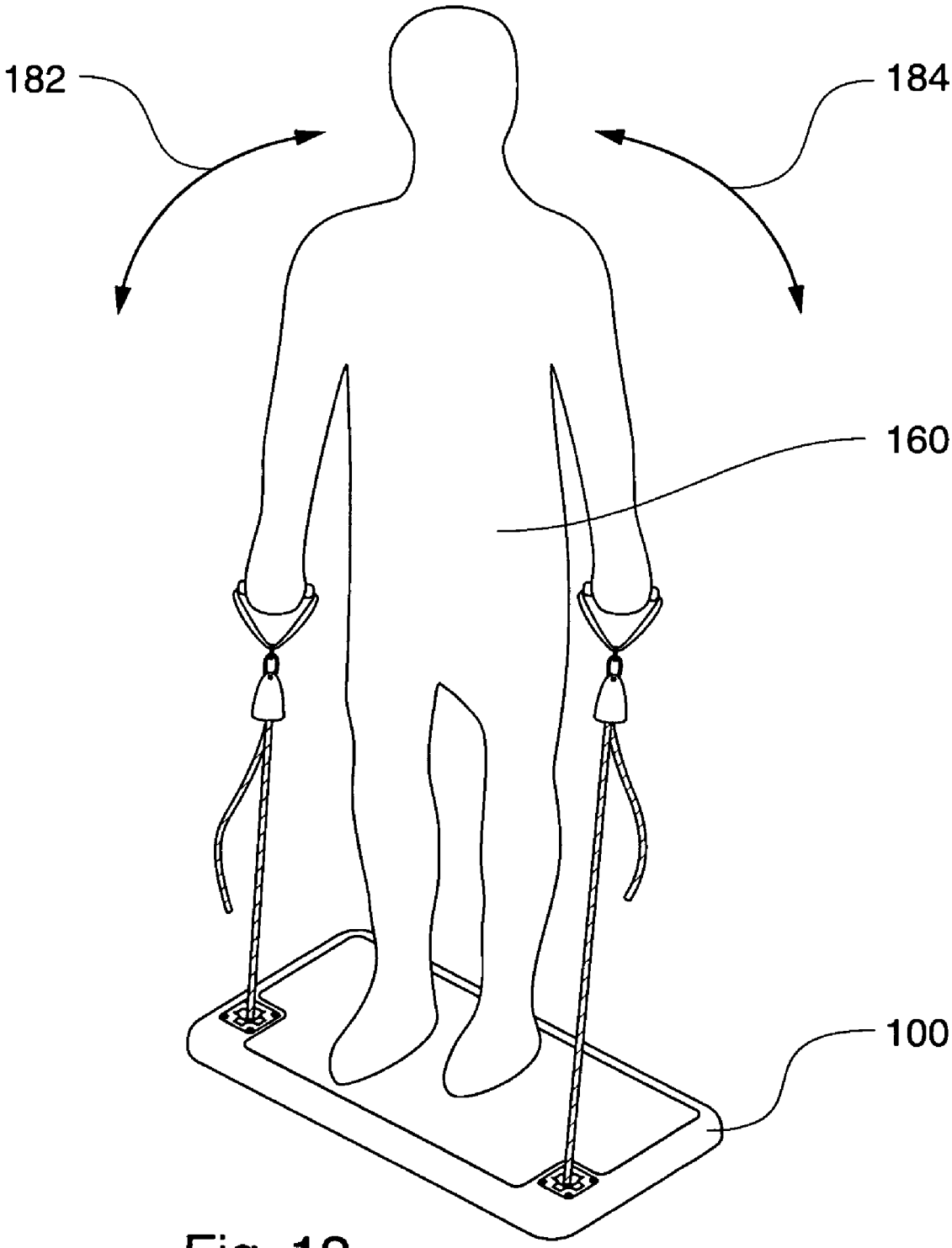

FIG. 12 depicts an eighth exercise posture wherein user 160 performs side bends. The user 160 stands in an erect manner with his arms at his sides and palms facing his sides. He bends his upper body or torso from side to side, arrows 182, 184 while keeping his arms straight and his feet stationary.

While eight possible exercise postures have been shown, it will be recognized by those of skill in the fitness and physical training arts that numerous other exercise postures, positions, and procedure are possible utilizing the novel exercise device in accordance with the present invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A portable exercise device, comprising:

a) a squat, substantially rectangular body having an upper surface, said upper surface being of sufficient size to receive and completely contain the entire foot of a user within a perimeter of the surface of said portable exercise device thereupon;

b) a first guide mechanism disposed proximate a front, right corner of said upper surface, and a second guide mechanism disposed proximate a front left corner of said upper surface; each of said first guide mechanism and said second guide mechanism having a central, cord-accepting opening disposed therein;

c) a cord disposed to pass through each of said central cord-receiving openings, said cord passing directly therebetween within an elongated trough in said squat, substantially rectangular body, said elongated trough having at least one support roller disposed therein for interaction with said cord having a proximal end extending outwardly from said first guide mechanism, and a distal end extending outwardly from said second guide mechanism; and d) a first handle removably attached to said cord proximate said proximal end thereof, and a second handle removably attached to said cord proximate said distal end thereof.

2. The portable exercise device as recited in claim 1, wherein said first guide mechanism and said second guide mechanism each comprise:

i) four mutually orthogonal guide rollers defining a central, cord-accepting opening therebetween; and ii) a guide roller support block supporting and retaining said four mutually orthogonal guide rollers.

3. The portable exercise device as recited in claim 2, wherein said first guide mechanism and said second guide mechanism each comprise:

iii means for attaching said first guide mechanism and said second guide mechanism to said body such that an upper surface of each of said first guide mechanism and said second guide mechanism is substantially flush with said upper surface of said body.

4. The portable exercise device as recited in claim 3, wherein said means for attaching comprises at least one selected from the group: at least one screw, an adhesive, and another mechanical fastener.

5. The portable exercise device as recited in claim 1, wherein at least one of said first handle and said second handle is selectively, adjustably attached to a respective proximal and distal end of said cord.

6. The portable exercise device as recited in claim 5, further comprising:

e) a cord length adjusting mechanism disposed between said cord and at least one of said first handle and said second handle.

7. The portable exercise device as recited in claim 6, wherein said cord length adjusting mechanism comprises a snap hook and at least one of said first handle and said second handle comprises a handle-attachment eye adapted for removable connection to said snap hook.

8. The portable exercise device as recited in claim 1, wherein said body comprises a hollow body comprising at least one feature selected from the group: at least one molded rib, an elongated trough disposed between said first guide assembly and said second guide assembly, and at least one foot receiving and retaining feature.

9. The portable exercise device as recited in claim 8, further comprising:

e) a roller support assembly retained within said elongated trough within said body.

10. The portable exercise device as recited in claim 9, wherein said roller support assembly comprises:

i) a flange; and ii) a first roller disposed proximate a distal end of said roller support assembly, and a second roller disposed proximate a proximal end of said roller support assembly, said first roller and said second roller adapted for rolling engagement with said cord within said hollow body.

11. The portable exercise device as recited in claim 1, further comprising:

e) a handle attached to said body.

12. The portable exercise device as recited in claim 1, further comprising:

e) a plurality of feet disposed on a bottom surface of said body.

* * * * *